US008590178B2

(12) United States Patent
Avar et al.

(10) Patent No.: US 8,590,178 B2
(45) Date of Patent: Nov. 26, 2013

(54) STABILITY AND COMFORT SYSTEM FOR AN ARTICLE OF FOOTWEAR

(75) Inventors: Eric P. Avar, Lake Oswego, OR (US); Tom Luedecke, Portland, OR (US); Matthew A. Nurse, Lake Oswego, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 781 days.

(21) Appl. No.: 12/359,624

(22) Filed: Jan. 26, 2009

(65) Prior Publication Data

US 2010/0186255 A1 Jul. 29, 2010

(51) Int. Cl.
*A43B 7/20* (2006.01)
*A43B 7/14* (2006.01)

(52) U.S. Cl.
USPC ..... 36/89; 36/88; 36/10; 36/92

(58) Field of Classification Search
USPC ..... 36/92, 93, 102, 114, 34 R, 35 R, 36 R, 36/36 A, 69, 88, 89, 144
See application file for complete search history.

(56) References Cited

U.S. PATENT DOCUMENTS 2,853,805 A * 9/1958 Dratman ..... 36/1
3,618,946 A 11/1971 Lee et al.
4,132,016 A * 1/1979 Vaccari ..... 36/114
4,622,764 A * 11/1986 Boulier ..... 36/68
5,371,957 A 12/1994 Gaudio
5,377,430 A 1/1995 Hatfield et al.
5,685,092 A * 11/1997 Prieskorn ..... 36/93
5,771,609 A * 6/1998 Messmer ..... 36/89
5,778,566 A * 7/1998 Edauw et al. ..... 36/117.1
5,802,740 A * 9/1998 Merk, Sr. ..... 36/55
5,909,885 A * 6/1999 Borel ..... 280/11.231
5,937,546 A * 8/1999 Messmer ..... 36/89
6,018,891 A * 2/2000 Duclos ..... 36/69
6,092,305 A 7/2000 Troy et al.
6,108,943 A 8/2000 Hudson et al.
6,470,600 B1 10/2002 Louie
6,519,876 B1 2/2003 Geer et al.
6,594,922 B1 * 7/2003 Mansfield et al. ..... 36/145
6,684,532 B2 2/2004 Greene et al.
6,701,640 B2 3/2004 Nakano (Continued)

FOREIGN PATENT DOCUMENTS

AU 4379179 8/1980
DE 1711184 11/1955
DE 1685782 1/1971

OTHER PUBLICATIONS

International Search Report and Written Opinion, mailed Oct. 1, 2010, from PCT Application No. PCT/US2010/021942.

(Continued)

*Primary Examiner* — Jila M Mohandesi
(74) *Attorney, Agent, or Firm* — Plumsea Law Group, LLC

(57) ABSTRACT

A stability and comfort system for an article of footwear is disclosed. The stability and comfort system includes a bootie and a sock liner. The sock liner may include a heel counter that is contoured to fit a heel. The sole of the article may include an outrigger portion. The outrigger portion can be separated from a central portion of the sole to allow the outrigger portion to move substantially independently of the central portion of the sole.

23 Claims, 12 Drawing Sheets

(56) References Cited

U.S. PATENT DOCUMENTS

| | | | | |
|---|---|---|---|---|
| 6,701,643 | B2 | 3/2004 | Geer et al. | |
| 6,748,676 | B1 * | 6/2004 | Chenevert | 36/115 |
| 6,827,696 | B1 * | 12/2004 | Maguire | 602/27 |
| 6,871,421 | B2 | 3/2005 | Potter et al. | |
| 6,874,252 | B2 | 4/2005 | Nakano | |
| 6,990,775 | B2 | 1/2006 | Koester | |
| 7,010,867 | B2 * | 3/2006 | Brown | 36/12 |
| 7,010,872 | B2 * | 3/2006 | Pawlus et al. | 36/100 |
| 7,013,583 | B2 | 3/2006 | Greene et al. | |
| 7,059,067 | B2 | 6/2006 | Geer et al. | |
| 7,076,889 | B2 * | 7/2006 | Palmer et al. | 36/12 |
| 7,096,602 | B2 * | 8/2006 | Palmer et al. | 36/12 |
| 7,168,188 | B2 * | 1/2007 | Auger et al. | 36/69 |
| D543,340 | S | 5/2007 | Favreau et al. | |
| 7,219,450 | B2 * | 5/2007 | Langley | 36/89 |
| 7,290,357 | B2 | 11/2007 | McDonald et al. | |
| RE40,215 | E | 4/2008 | Cummings et al. | |
| 7,370,438 | B2 | 5/2008 | Vattes et al. | |
| 7,472,496 | B2 | 1/2009 | Potter et al. | |
| 2002/0083618 | A1 * | 7/2002 | Erickson et al. | 36/44 |
| 2004/0103561 | A1 * | 6/2004 | Campbell et al. | 36/88 |
| 2004/0194348 | A1 | 10/2004 | Campbell et al. | |
| 2004/0244221 | A1 | 12/2004 | Hall et al. | |
| 2006/0053662 | A1 * | 3/2006 | Yang | 36/115 |
| 2006/0213081 | A1 | 9/2006 | Geer et al. | |
| 2007/0199213 | A1 | 8/2007 | Campbell et al. | |
| 2007/0227038 | A1 | 10/2007 | Edington et al. | |
| 2008/0216355 | A1 | 9/2008 | Becker et al. | |
| 2008/0289220 | A1 | 11/2008 | Rivas et al. | |
| 2009/0019729 | A1 * | 1/2009 | Nakano et al. | 36/91 |
| 2009/0019730 | A1 * | 1/2009 | Salminen et al. | 36/91 |
| 2009/0139111 | A1 * | 6/2009 | Joseph | 36/92 |

OTHER PUBLICATIONS

International Preliminary Report on Patentability (including Written Opinion of the ISA) mailed Aug. 4, 2011 in International Application No. PCT/US2010/021942.

Invitation to Pay Additional Fees mailed Jul. 1, 2010 in PCT Application No. PCT/US2010/021942.

* cited by examiner

STABILITY AND COMFORT SYSTEM FOR AN ARTICLE OF FOOTWEAR

BACKGROUND

The present invention relates to an article of footwear, and in particular to a stability system for footwear.

Articles with comfort and stability systems have been proposed. Hall et al. (U.S. patent application publication number 2004/0244221) teaches a hybrid footwear liner. Hall teaches an article including a sock liner that may be inserted into a snowboard boot.

Geer et al. (U.S. patent application publication number 2006/0213081) teaches a footwear structure and method of forming the same. Greer teaches a shoe construction that includes a heel counter in one embodiment. Geer also teaches that the counter may also be incorporated on the exterior surface of an upper or portion thereof, e.g. as an external counter, a removable liner or bootie, or between a lining and an outer upper portion. The counter may also extend to the ball of the foot and may be angled to facilitate shock absorption during heel strike.

Vattes et al. (U.S. Pat. No. 7,370,438) teaches a removable or reversible lining for footwear. Vattes teaches a shoe with a footbed and a liner.

Hudson et al. (U.S. Pat. No. 6,108,943) teaches an article of footwear having medial and lateral sides with differing characteristics. Hudson teaches an outsole that extends laterally from the midsole by about 1-2 mm. This extension forms outward extensions with overhangs that act as outriggers to prevent roll over and enhance the wearer's ability to balance on the lateral edge. Hudson also teaches flex grooves that are perpendicular to the lateral edge.

Edington et al. (U.S. patent application publication number 2007/0227038) teaches interior and upper members for articles of footwear and other foot-receiving devices. Edington teaches a sole that includes a perimeter element. The perimeter element helps hold the midsole member, upper member, heel counter, and other structures in place. Edington teaches that the perimeter further includes a raised lateral edge portion to help support, abut, prevent movement of, and/or contain the lateral side of the user's foot. Edington teaches an area that can include a support member (such as a plastic or metal plate). Edington also teaches a plurality of recesses extending in a direction from the lateral to medial side.

SUMMARY

The invention discloses an article of footwear with a stability and comfort system. In one aspect, the invention provides an article of footwear, comprising: a sock liner including a heel counter portion; the sock liner including a longitudinal direction associated with a length of a sole; the sock liner including a lateral direction associated with a width of the sole, the lateral direction being generally perpendicular to the longitudinal direction; the sock liner including a vertical direction that is generally perpendicular to the longitudinal direction and the lateral direction; the heel counter portion including a first heel counter section and a second heel counter section wherein the first heel counter section is disposed below the second heel counter section in a generally vertical direction; the first heel counter section including a first end portion and a second end portion that are oriented substantially in the longitudinal direction; the first end portion and the second end portion being separated by a first distance substantially oriented in the lateral direction; the second heel counter section including a third end portion and a fourth end portion that are oriented substantially in the longitudinal direction; the third end portion and the fourth end portion being separated by a second distance substantially oriented in the lateral direction; and where the first distance is greater than the second distance.

In another aspect, the invention provides an article of footwear, comprising: a sock liner including a heel counter portion; the sock liner including a longitudinal direction associated with a length of a sole; the sock liner including a lateral direction associated with a width of the sole, the lateral direction being generally perpendicular to the longitudinal direction; the sock liner including a vertical direction that is generally perpendicular to the longitudinal direction and the lateral direction; the heel counter portion including a first heel counter section and a second heel counter section wherein the first heel counter section is disposed below the second heel counter section in a generally vertical direction; the first heel counter section including a first end portion, a second end portion and a first intermediate portion disposed between the first end portion and the second end portion; the second heel counter section including a third end portion, a fourth end portion and a second intermediate portion disposed between the third end portion and the fourth end portion; and where the first intermediate portion has a first curvature than is greater than a second curvature associated with the second intermediate portion.

In another aspect, the invention provides an article of footwear, comprising: a sock liner including a heel counter portion; the sock liner including a longitudinal direction associated with a length of a sole; the sock liner including a lateral direction associated with a width of the sole, the lateral direction being generally perpendicular to the longitudinal direction; the sock liner including a vertical direction that is generally perpendicular to the longitudinal direction and the lateral direction; the heel counter portion including a first heel counter section and a second heel counter section wherein the first heel counter section is disposed below the second heel counter section in a generally vertical direction; and where a portion of the first heel counter section extends rearwards of the second heel counter section in the longitudinal direction.

In another aspect, the invention provides an article of footwear, comprising: a sock liner including a heel counter portion; the sock liner including a longitudinal direction associated with a length of the sole; the sock liner including a lateral direction associated with a width of a sole, the lateral direction being generally perpendicular to the longitudinal direction; the sock liner including a vertical direction that is generally perpendicular to the longitudinal direction and the lateral direction; the heel counter portion including a first heel counter section and a second heel counter section wherein the first heel counter section is disposed below the second heel counter section in a generally vertical direction; the first heel counter section including a first end portion and a second end portion that are oriented substantially in the longitudinal direction; the first end portion and the second end portion being separated by a first distance substantially oriented in the lateral direction; the second heel counter section including a third end portion and a fourth end portion that are oriented substantially in the longitudinal direction; the third end portion and the fourth end portion being separated by a second distance substantially oriented in the lateral direction; the first heel counter section including a first intermediate portion disposed between the first end portion and the second end portion, the first intermediate portion being associated with a first curvature; the second heel counter section including a second intermediate portion disposed between the third end portion and the fourth end portion, the second intermediate portion being associated with a second curvature; and wherein the first distance is greater than the second distance and wherein the first curvature is greater than the second curvature and wherein the first heel counter section is disposed further rearward of the second heel counter section in the longitudinal direction.

In another aspect, the invention provides an article of footwear, comprising: a sole including a forefoot portion, the forefoot portion further including a central portion a peripheral portion disposed outwards from the central portion; an outrigger portion disposed on the peripheral portion; and where the outrigger portion is separated from the central portion by a flex groove.

In another aspect, the invention provides an article of footwear, comprising: a sole including a forefoot portion, the forefoot portion further including a central portion a peripheral portion disposed outwards from the central portion; an outrigger portion disposed on the peripheral portion; and where the outrigger is configured to move substantially independently of the central portion.

In another aspect, the invention provides an article of footwear, comprising: a sole including a forefoot portion, the forefoot portion further including a central portion a peripheral portion disposed outwards from the central portion; an outrigger disposed on the peripheral portion; a flex groove extending through the forefoot portion and including a first end portion disposed on an outer peripheral edge of the peripheral portion and the flex groove including a second end portion disposed on the outer peripheral edge; and where a portion of the outrigger portion is disposed between the first end portion and the second end portion on the outer peripheral edge.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE EXEMPLARY EMBODIMENTS

Figure 1:
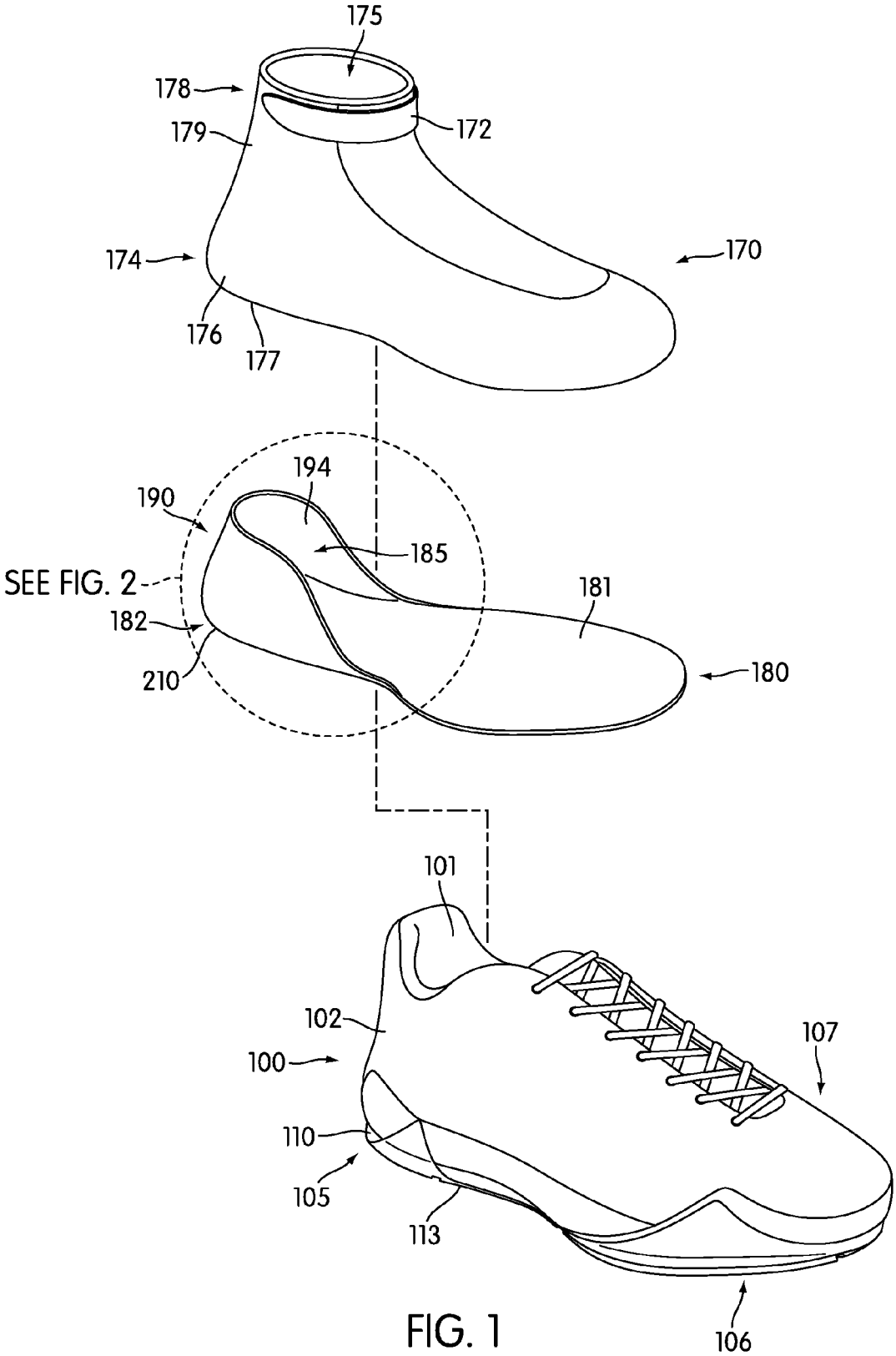
FIG. 1 is an exploded isometric view of an exemplary embodiment of an article of footwear with a sock liner and a bootie.
Figure 2:
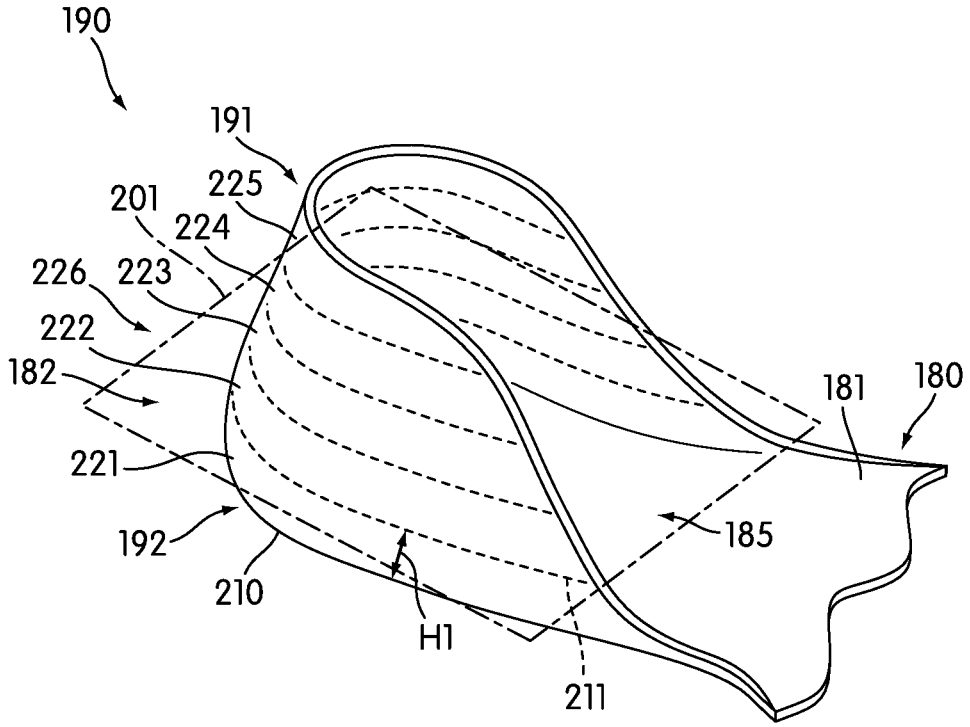
FIG. 2 is an isometric view of an exemplary embodiment of a heel counter portion of a sock liner.

FIG. 1 illustrates an exemplary embodiment of article of footwear 100. In particular, FIG. 1 is an exploded isometric view of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a right foot; however, it should be understood that the following discussion may equally apply to a mirror image of article of footwear 100 that is intended for use with a left foot.

Article of footwear 100 includes upper 102. Upper 102 is configured to receive a foot of a wearer of article 100. Generally, upper 102 may be any type of upper. In particular, upper 102 could have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Upper 102 may comprise medial portion 106. Medial portion 106 may be associated with an inside of a foot. Likewise, upper 102 can comprise lateral portion 107 disposed opposite of medial portion 106. Lateral portion 107 may be associated with an outside of a foot.

Article of footwear 100 also includes sole 105. In different embodiments, sole 105 may include different components. For example, sole 105 may include an outsole, a midsole, and/or an insole. In one embodiment, sole 105 includes midsole 110 and outsole 113.

An article can include provisions for facilitating comfort and stability of a foot. In some cases, an article can include a sock liner that is configured to facilitate stability. In addition, an article can include a bootie or removable lining that is configured to facilitate comfort and stability.

Referring to FIG. 1, article 100 includes sock liner 180. In this embodiment, sock liner 180 is configured to insert into entry hole 101 of upper 102. In some cases, sock liner 180 may be a full length sock liner that is configured to stretch over a substantial entirety of a foot bed of article 100. In other cases, however, sock liner 180 could be configured to cover only a portion of a foot bed.

In an exemplary embodiment, sock liner 180 includes lower portion 181 that may be configured to cover a substantial entirety of a foot bed of article 100. Sock liner 180 also includes heel portion 182 that may be associated with a heel of a foot. In some cases, heel portion 182 may receive a heel of a foot through sock liner opening 185 of sock liner 180.

Article 100 may also include bootie 170. In some cases, bootie 170 may be a removable liner for upper 102. In other cases, bootie 170 may be a separate component from upper 102 configured to provide additional cushioning and support. In an exemplary embodiment, bootie 170 is configured to wrap around a substantial entirety of a foot.

Bootie 170 can include provisions for fastening to a foot. In some cases, bootie 170 may be an elastic type bootie that conforms to a foot. In other cases, bootie 170 can include a fastener that helps fasten bootie 170. For example, in the current embodiment, bootie 170 includes strap fastener 172. In some cases, strap fastener 172 may be an elastic strap that may be fastened around a portion of bootie opening 175. In one embodiment, strap fastener 172 can include a hook and loop type fastening system for tightening strap fastener 172 in place.

In this exemplary embodiment, bootie 170 may be configured to insert into entry hole 101 of upper 102. In some cases, bootie 170 may be inserted into entry hole 101 after sock liner 180 has been inserted through entry hole 101. With this arrangement, sock liner 180 may be disposed between a bottom portion of upper 102 and bootie 170.

One or more components of a stability system can include provisions for enhancing stability of a foot, especially a heel of the foot. In some embodiments, a bootie of a stability system can be shaped to enhance stability and comfort for a heel. In some cases, a sock liner can be associated with a heel counter to provide stability and comfort for a heel.

In one embodiment, bootie 170 can include contoured heel portion 174. In some cases, contoured heel portion 174 can be a portion of bootie 170 that is shaped to fit snugly with the heel of a foot. In particular, contoured heel portion 174 can include widened portion 176 at heel base 177 of bootie 170. Also, contoured heel portion 174 can include narrowed portion 178 at upper heel portion 179 of bootie 170. In other words, contoured heel portion 174 is configured to fit the natural shape of a heel, which is wider at the base and narrower at the portion closest to the ankle.

In an exemplary embodiment, sock liner 180 includes heel counter portion 190. Heel counter portion 190 can be integrally formed with sock liner 180. In some cases, heel counter portion 190 is disposed on, and integral with, heel portion 182 of sock liner 180. Heel counter portion 190 may include interior portion 194 that may receive a heel to provide stability and comfort.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of an article. Also, the term "lateral" as used throughout this detailed description and in the claims refers to a direction extending a width of an article. In other words, the lateral direction may extend between a medial and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It should be understood that the terms longitudinal, lateral and vertical may also be applied to other components associated with the article, including a sole, a sock liner and/or a bootie.

FIGS. 2 through 6 illustrate various views of an exemplary embodiment of a heel counter portion of a sock liner. For purposes of understanding the geometry of the heel counter portion, the heel counter portion may be divided into a plurality of heel counter sections. These heel counter sections may be created by an intersection of a heel counter portion with one or more planes that are substantially parallel with a lower portion of the sock liner. For example, in the current embodiment, first plane 210 may be substantially parallel with lower portion 181. The intersection between first plane 210 and heel counter portion 190 may form first boundary 211 of heel counter portion 190. In some cases, boundaries formed by the intersection of one or more planes with heel counter portion 190 may provide divisions between adjacent heel counter sections. In the current embodiment, first boundary 211 separates first heel counter section 221 and second heel counter section 222 of heel counter portion 190.

In a similar manner, additional planes that are substantially parallel to lower portion 181 may intersect heel counter portion 190 to form additional boundaries. For example, three planes intersecting heel counter portion 190 may form three boundaries disposed at different vertical heights of heel counter portion 190. The three boundaries may separate third heel counter section 223, fourth heel counter section 224 and fifth heel counter section 225. For clarity, first heel counter section 221, second heel counter section 222, third heel counter section 223, fourth heel counter section 224 and fifth heel counter section 225 may be collectively referred to as plurality of heel counter sections 226.

As heel counter portion 190 is divided into plurality of heel counter sections 226 for the purpose of understanding the geometry of heel counter portion 190, the heel counter sections may be associated with different portions of heel counter portion 190. For example, fifth heel counter section 225 may be associated with upper heel portion 191 of heel counter portion 190. Upper heel portion 191 may be configured to wrap around a portion of a heel closest to an ankle. In a similar manner, first heel counter section 221 may be associated with lower heel portion 192 of heel counter portion 190. Lower heel portion 192 may be configured to wrap around a base portion of a heel. Likewise, second heel counter section 222, third heel counter section 223 and fourth heel counter section 224 may be disposed between first heel counter section 221 and fifth heel counter section 225.

For purposes of clarity, heel counter portion 190 is only divided into five heel counter sections in the current embodiment, each with approximately the same vertical height H1. In other embodiments, however, heel counter portion 190 could be divided into any other number of heel counter sections with various different vertical heights.

It should be understood that the division of heel counter portion 190 into heel counter sections is only used for purposes of explaining the geometric characteristics of heel counter portion 190. In an exemplary embodiment, heel counter portion 190 may form a single monolithic portion that is integrally formed with sock liner 180.

Generally, each heel counter section of plurality of heel counter sections 226 may have a substantially similar shape. In some cases, each heel counter section may be approximately U shaped. In other cases, each heel counter section may be approximately horseshoe shaped. For example, each heel counter section can include a first end portion and a second end portion that are oriented in a substantially longitudinal direction along the medial and lateral sides, respectively, of heel counter portion 190. In addition, each heel counter section can include a curved intermediate portion that is disposed between the first end portion and the second end portion. With this configuration, each heel counter section may have a shape that approximates rear peripheral edge 201 that is disposed adjacent to lower heel portion 192 of heel counter portion 190.

Figure 3:
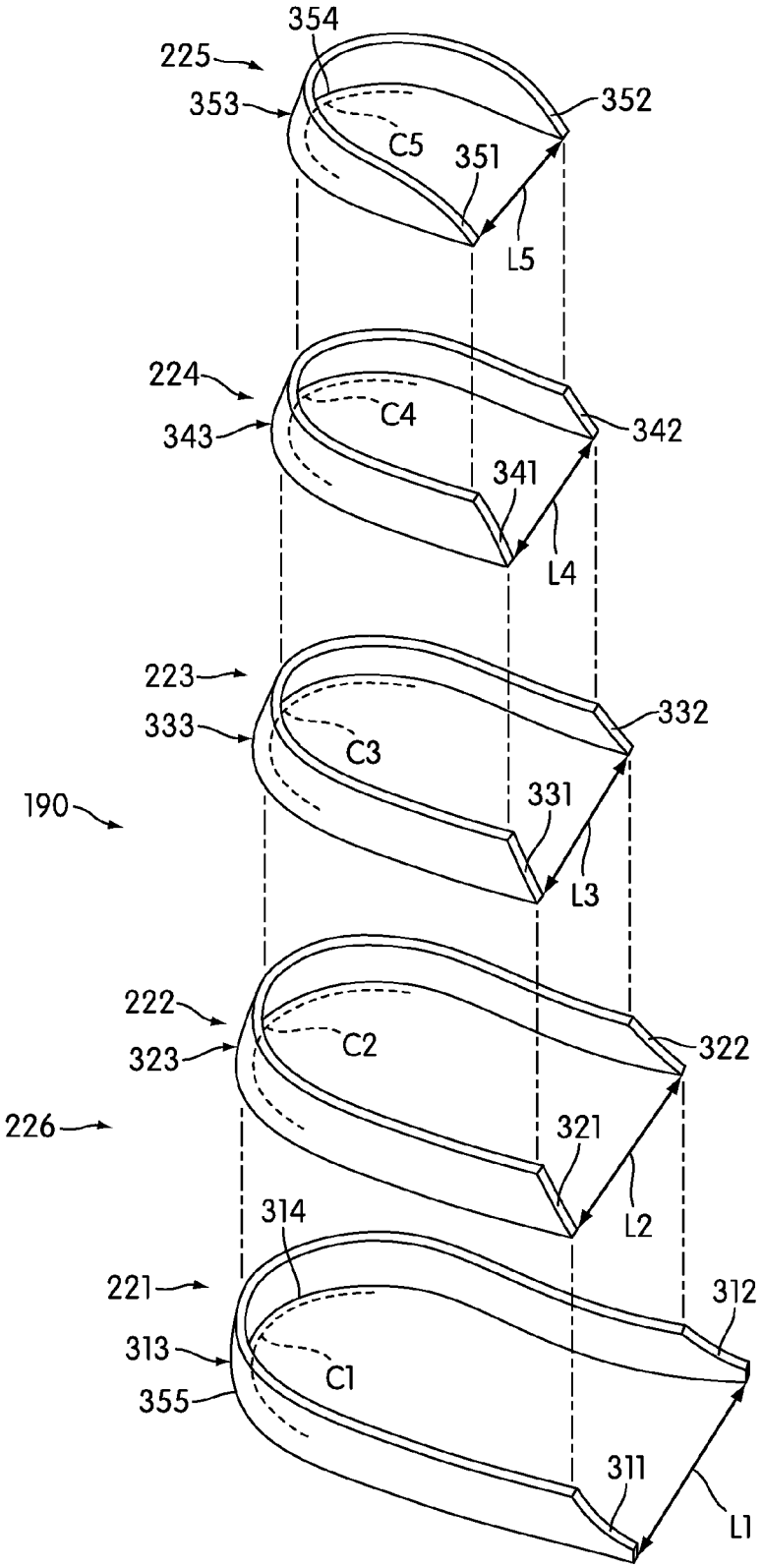
FIG. 3 is an exploded isometric view of an exemplary embodiment of a heel counter portion of a sock liner.

FIG. 3 illustrates an exploded isometric view of heel counter portion 190. Referring to FIG. 3, each heel counter section is exploded in a substantially vertical direction for purposes of illustration. In one embodiment, first heel counter section 221 includes first end portion 311 that may be associated with medial portion 106 of article 100, as illustrated in FIG. 1. Likewise, first heel counter section 221 can include second end portion 312 that may be associated with lateral portion 107 of article 100, as illustrated in FIG. 1. Also, first heel counter section 221 may include first intermediate portion 313, disposed between first end portion 311 and second end portion 312. With this configuration, first heel counter section 221 may have an approximately horseshoe shape that approximates rear peripheral edge 201.

The remaining heel counter sections of plurality of heel counter sections 226 may be configured in a similar manner. For example, second heel counter section 222 may include first end portion 321, second end portion 322 and second intermediate portion 323 disposed between first end portion 321 and second end portion 322. Also, third heel counter section 223 may include first end portion 331, second end portion 332 and third intermediate portion 333. Similarly, fourth heel counter section 224 can include first end portion 341, second end portion 342 and fourth intermediate portion 343. Finally, fifth heel counter section 225 includes first end portion 351, second end portion 352 and fifth intermediate portion 353.

End portions of heel counter sections may be separated by various distances. In one embodiment, first end portion 311 and second end portion 312 of first heel counter section 221 may be separated by first distance L1 in a substantially lateral direction. Similarly, first end portion 321 and second end portion 322 of second heel counter section 222 may be separated by second distance L2. Likewise, first end portion 331 and second end portion 332 of third heel counter section 223 may be separated by third distance L3. In a similar manner, first end portion 341 and second end portion 342 of fourth heel counter section 224 may be separated by fourth distance L4. Finally, first end portion 351 and second end portion 352 of fifth heel counter section 225 may be separated by fifth distance L5.

In some embodiments, an intermediate portion of a heel counter section may be curved. For example, first interior portion 314 of first intermediate portion 313 of first heel counter section 221, which faces inwards towards a heel, may have a substantially concave shape. In a similar manner, exterior portion 355, disposed opposite of interior portion 314, may have a substantially convex shape. In an exemplary embodiment, the concave shape of first interior portion 314 can be associated with first curvature C1. In a similar manner, the interior portions of intermediate portions of second heel counter section 222, third heel counter section 223, fourth heel counter section 224 and fifth heel counter section 225 can be associated with second curvature C2, C3, C4 and C5, respectively.

Figure 4:
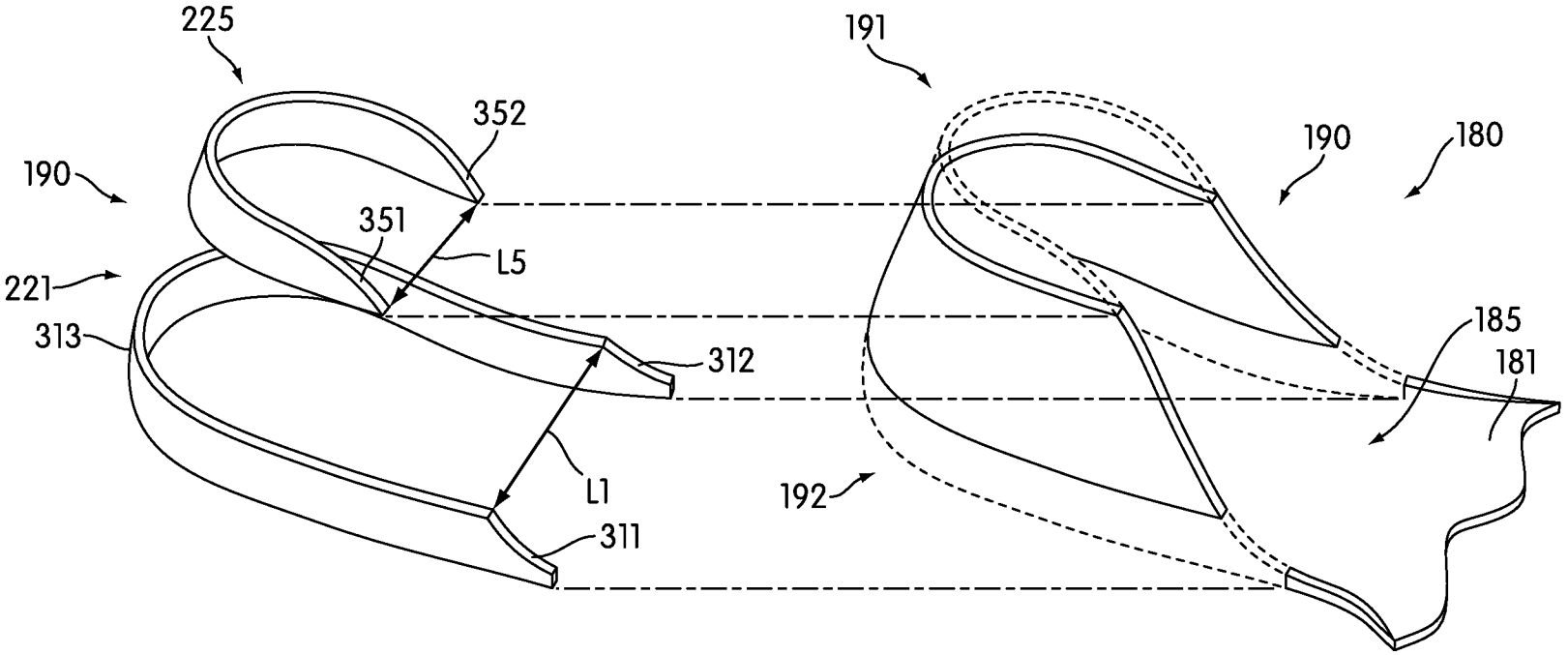
FIG. 4 is an exploded isometric view of an exemplary embodiment of a heel counter portion of a sock liner.
Figure 5:
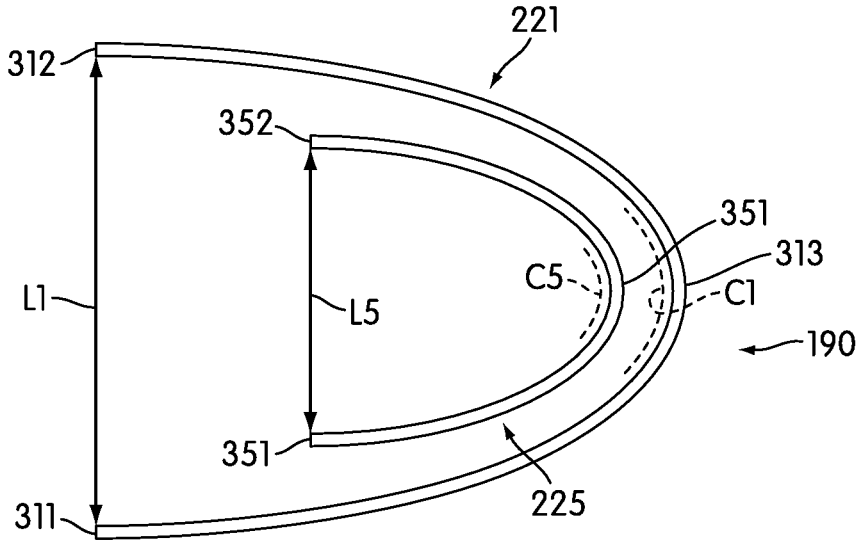
FIG. 5 is a top down view of an exemplary embodiment of a portion of a heel counter portion of a sock liner.

FIGS. 4 and 5 illustrate an isometric view of a portion of heel counter portion 190. In particular, FIG. 4 illustrates an exploded isometric view of two heel counter sections of heel counter portion 190 and FIG. 5 illustrates a top down view of the two exploded heel counter sections. The purpose of these illustrations is to compare the different geometric characteristics of two heel counter sections of heel counter portion 190. However, it should be understood that heel counter portion 190 is integrally formed and divided into heel counter sections only to explain the geometric characteristics of heel counter portion 190. In an exemplary embodiment, heel counter portion 190 may form a single monolithic portion that is integrally formed with sock liner 180.

Referring to FIG. 4, first heel counter section 221 may be disposed below fifth heel counter section 225 in a generally vertical direction. As previously discussed, first heel counter section 221 may be disposed adjacent to lower heel portion 192. Similarly, fifth heel counter section 225 may be disposed adjacent to upper heel portion 191. With this arrangement, first heel counter section 221 may be associated with a base portion of a heel and fifth heel counter section 225 may be associated with a portion of a heel closest to an ankle.

In order to provide comfort and stability to a heel, a heel counter may be configured to approximate the natural shape of a heel, which is wider at the base and narrower at the portion closest to the ankle. In some embodiments, the width of the heel counter portion may vary to fit a contour of a heel. This can be accomplished by varying the distance between end portions of heel counter sections to accommodate the changing width of a heel. In one embodiment, the distance between end portions of adjacent heel counter sections may vary so that heel counter sections disposed closer to a lower portion of a heel counter portion have a greater distance between end portions than heel counter sections disposed closer to an upper portion of a heel counter portion.

The distance between end portions of first heel counter section 221 and fifth heel counter section 225 may be configured to accommodate a wider base portion of a heel and a narrower portion of a heel closest to an ankle. As previously discussed, first end portion 311 and second end portion 312 of first heel counter section 221 may be separated by first distance L1. Likewise, first end portion 351 and second end portion 352 of fifth heel counter section 225 may be separated by fifth distance L5. In some cases, first distance L1 may be greater than fifth distance L5.

In a similar manner, the distances between end portions of any two heel counter sections may be configured so that the heel counter section disposed closer to lower heel portion 192 may have a greater distance between two end portions than the heel counter section disposed closer to upper heel portion 191. In other words, the distance between end portions of heel counter sections may generally increase with proximity to lower heel portion 192. For example, referring to FIG. 3, second distance L2 may be greater than third distance L3. Likewise, third distance L3 may be greater than fourth distance L4. Finally, fourth distance L4 may be greater than fifth distance L5. By increasing the distances between end portions of heel counter sections, the heel counter portion may approximate the wider base portion of a heel and narrower portion of a heel closest to the ankle.

It will be understood that this general progression of narrowing heel counter sections in the vertical direction is only intended to be approximate. In some cases, for example, second heel counter section 222 could be slightly wider than first heel counter section 221 to accommodate a slight bulge in a heel just above the base of the heel.

Typically, the curvature of a heel increases as the heel narrows at a portion closest to an ankle. In other words, the curvature of a heel may be more rounded at a base portion of a heel and sharper at a portion closest to an ankle. In some embodiments, the curvatures of intermediate portions of heel counter sections may also vary to conform to the change in curvature of a heel of a foot. In some cases, the curvature of intermediate portions of heel counter sections disposed closer to an upper heel portion may be approximately greater than the curvature of intermediate portions of heel counter sections disposed closer to a lower heel portion of a heel counter portion. Using this configuration, a heel counter portion may conform to the changing in curvature of a heel of a foot.

Referring to FIG. 5, fifth curvature C5 of fifth heel counter section 225 may be greater than first curvature C1 of first heel counter section 221. In some cases, first curvature C1 may be a gradual curve that conforms to the rounded curvature of a base portion of a heel. In contrast, fifth curvature C5 of fifth heel counter section 225 may comprise a greater curve to conform to the greater curvature of a portion of a heel closest to an ankle.

Generally, the curvatures of intermediate portions of plurality of heel counter sections 226 may increase with closer proximity to upper heel portion 191. For example, referring to FIG. 3, third curvature C3 of third heel counter section 223 may be greater than second curvature C2 of second heel counter section 222. Also, fourth curvature C4 of fourth heel counter section 224 may be greater than third curvature C3 of third heel counter section 223. In addition, fifth curvature C5 of fifth heel counter section 225 may be greater than fourth curvature C4 of fourth heel counter section 224. This arrangement allows the curvature of intermediate portions of plurality of heel counter sections 226 to accommodate the narrowing of a heel from a base portion of the heel to a portion of the heel adjacent to an ankle.

It will be understood that the increase in curvature of heel counter sections in the vertical direction is only intended to be approximate. For example, in some cases, second curvature C2 can be slightly greater than first curvature C1 to accommodate the slight bulge in heel counter portion 190 at second heel counter section 222.

In some cases, a rear portion of a heel may be curved in a manner that conforms to the shape of the rear of a heel, which bulges at the base and tapers inwardly towards the ankle. To accommodate this, heel counter sections may be staggered in a longitudinal direction from a base of the heel counter portion to a top of the heel counter portion. For example, in some embodiments, a heel counter section disposed closer to a lower portion of a heel counter portion may extend further rearward than a heel counter section disposed closer to an upper portion of a heel counter portion.

Figure 6:
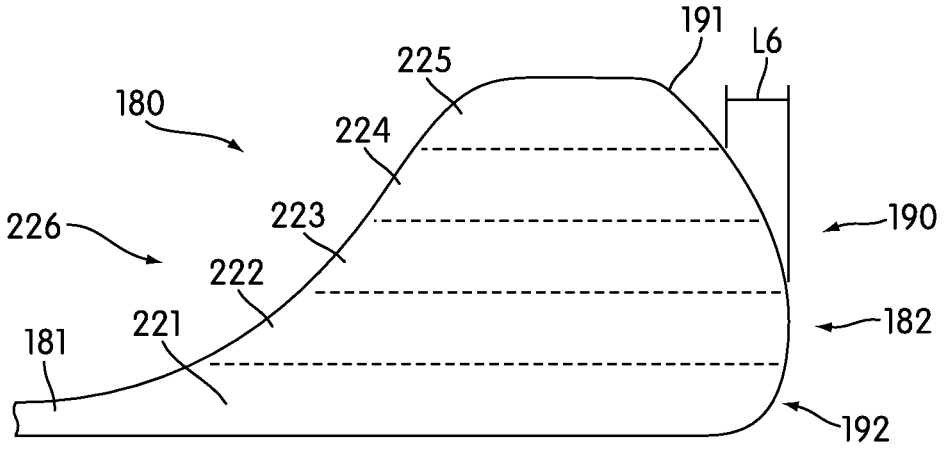
FIG. 6 is a side view of an exemplary embodiment of a heel counter portion of a sock liner.

Referring to FIG. 6, a side view of heel counter 190, second heel counter section 222 may extend rearward of fifth heel counter section 225 in a generally longitudinal direction. In one embodiment, second heel counter section 222 may extend rearward of fifth heel counter section 225 by sixth distance L6. With this arrangement, heel counter portion 190 may accommodate the greater outward extension, or bulge, of a lower portion of a heel and the shorter length of a portion of a heel closest to an ankle.

It will be understood that in some cases, second heel counter section 222 can extend even further rearwards than first heel counter section 221, as illustrated in FIG. 6, to accommodate the shape of a heel. In other cases, however, first heel counter section 221 can be disposed further rearwards of second heel counter section 222.

In a similar manner, heel counter sections disposed between first heel counter section 221 and fifth heel counter section 225 may be displaced with respect to one another in a substantially longitudinal direction. In some embodiments, heel counter sections disposed closer to lower heel portion 192 may extend rearward of heel counter sections disposed closer to upper heel portion 191. Of course this general trend is only approximate, as illustrated by the fact that second heel counter section 222 is disposed further rearwards of first heel counter section 221, as discussed above. With this arrangement, heel counter portion 190 may approximate the tapering shape of a rearward portion of a heel.

By changing the geometric characteristics of heel counter sections, a heel counter portion may accommodate the shape of a heel. This configuration of a plurality of heel counter sections may allow a heel counter portion to cradle a heel of a foot in a longitudinal, lateral and vertical direction. As a heel counter portion cradles a heel of a foot, a heel counter portion can provide increased stability and comfort to a heel of a foot.

Article 100 may be made from materials known in the art for making articles of footwear. For example, sole 105 may be made from any suitable material, including, but not limited to: elastomers, siloxanes, natural rubber, other synthetic rubbers, aluminum, steel, natural leather, synthetic leather, or plastics. Also, upper 102 may be made from any suitable material, including, but not limited to: nylon, natural leather, synthetic leather, natural rubber or synthetic rubber. In some cases, upper 102 can be made of any suitable knitted, woven or non-woven material.

Bootie 170 and sock liner 180 may be made from materials known in the art for making booties and sock liners. In some embodiments, bootie 170 and sock liner 180 may be made from any suitable knitted, woven or non-woven material. In other embodiments, bootie 170 and sock liner 180 may be made from any suitable material, including, but not limited to: nylon, natural leather, synthetic leather, natural rubber or synthetic rubber. In some cases, heel counter portion 190 may be made from a flexible material such as rubber.

Figure 7:
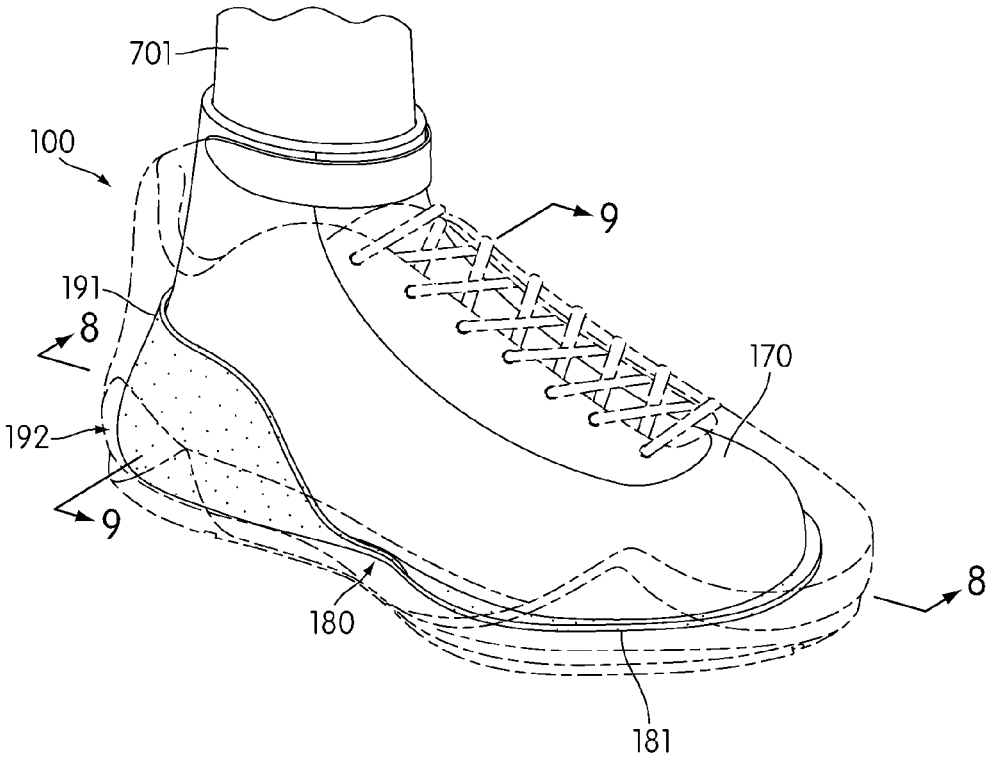
FIG. 7 is an isometric view of an exemplary embodiment of an article of footwear, illustrated in phantom, with a sock liner and a bootie.
Figure 8:
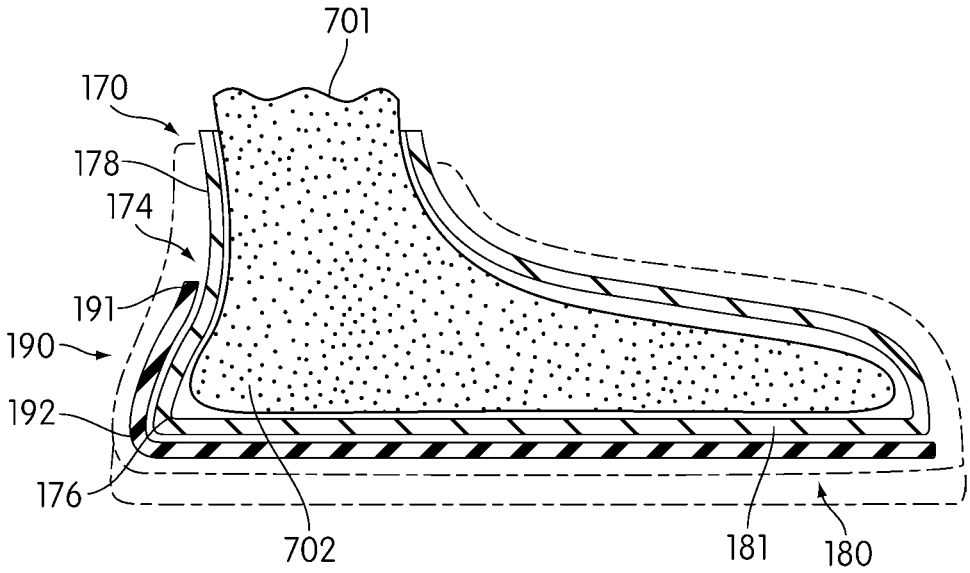
FIG. 8 is a side view of an exemplary embodiment of an article of footwear, illustrated in phantom, with a sock liner and a bootie.
Figure 9:
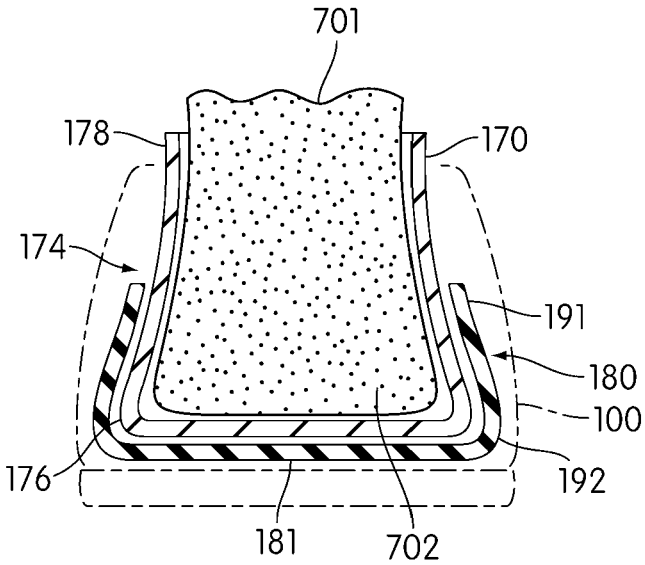
FIG. 9 is a cross sectional view of an exemplary embodiment of a heel portion of an article of footwear, illustrated in phantom, with a sock liner and a bootie.

FIGS. 7-9 illustrate an exemplary embodiment of foot 701 inserted within article 100. In one embodiment, foot 701 may be wearing bootie 170. Furthermore, sock liner 180 may be inserted within article 100 so that sock liner 180 is disposed between bootie 170 and article 100. This configuration can allow bootie 170 and sock liner 180 to work together as a comfort and stability system for foot 701. For purposes of clarity, article 100 is illustrated in phantom in these embodiments in order to illustrate the fit of bootie 170 and sock liner 180 to foot 701 within article 100.

As previously discussed, in some embodiments, bootie 170 may be an elastic type bootie that conforms to foot 701. In other embodiments, bootie 170 may be pre-contoured to fit a foot. These different arrangements can allow bootie 170 to fit snugly around a substantial entirety of foot 701.

In some embodiments, contoured heel portion 174 of bootie 170 may conform to the shape of heel 702 of foot 701. Referring to FIGS. 8 and 9, widened portion 176 of contoured heel portion 174 may fit around a wider base of heel 702. Similarly, narrowed portion 178 of contoured heel portion 174 may conform to a narrow portion of heel 702 closest to an ankle. With this arrangement, contoured heel portion 174 may provide comfort to foot 701 by fitting the natural shape of heel 702.

In a similar manner, sock liner 180 may also provide comfort to foot 701 by fitting the natural shape of foot 701. In particular, lower portion 181 of sock liner 180 may conform to a lower portion of foot 701. In addition, interior portion 194 of heel counter portion 190 may conform to the shape of heel 702.

As previously discussed, heel counter portion 190 may conform to the shape of heel 702 in a generally lateral, longitudinal and vertical direction. For example, the curvature of interior portion 194 of heel counter portion 190 can vary to fit the shape of heel 702. Referring to FIG. 7, lower heel portion 192 may be associated with a wider curvature than upper heel portion 191. This allows lower heel portion 192 to fit the wider and more rounded base of heel 702. Likewise, upper heel portion 191 may fit the greater curvature of an upper portion of heel 702. In addition, heel counter portion 190 may be contoured to fit heel 702 in a vertical direction. Referring to FIG. 8, lower heel portion 192 may extend further rearward than upper heel portion 191. This allows heel counter portion 190 to conform to the contoured vertical shape of heel 702 as heel 702 extends rearward. Furthermore, heel counter portion 190 may also conform to the lateral shape of heel 702. Referring to FIG. 9, lower heel portion 192 of heel counter portion 190 may conform to the wider shape of a base portion of heel 702. Similarly, upper heel portion 191 of heel counter portion 190 may narrow to fit the narrower shape of an upper portion of heel 702.

By conforming to the shape of heel 702, heel counter portion 190 can provide stability to heel 702. In some cases, heel counter portion 190 may reduce unwanted movement of heel 702. In other words, as heel counter portion 190 conforms to heel 702, heel counter portion 190 may eliminate unwanted space in a heel of article 100 and prevent heel 702 from slipping to a side. Furthermore, in embodiments that include bootie 170, bootie 170 can provide a layer of comfort between heel counter portion 190 and foot 701. This may increase the comfort of foot 701 while providing stability to heel 702.

Figure 10:
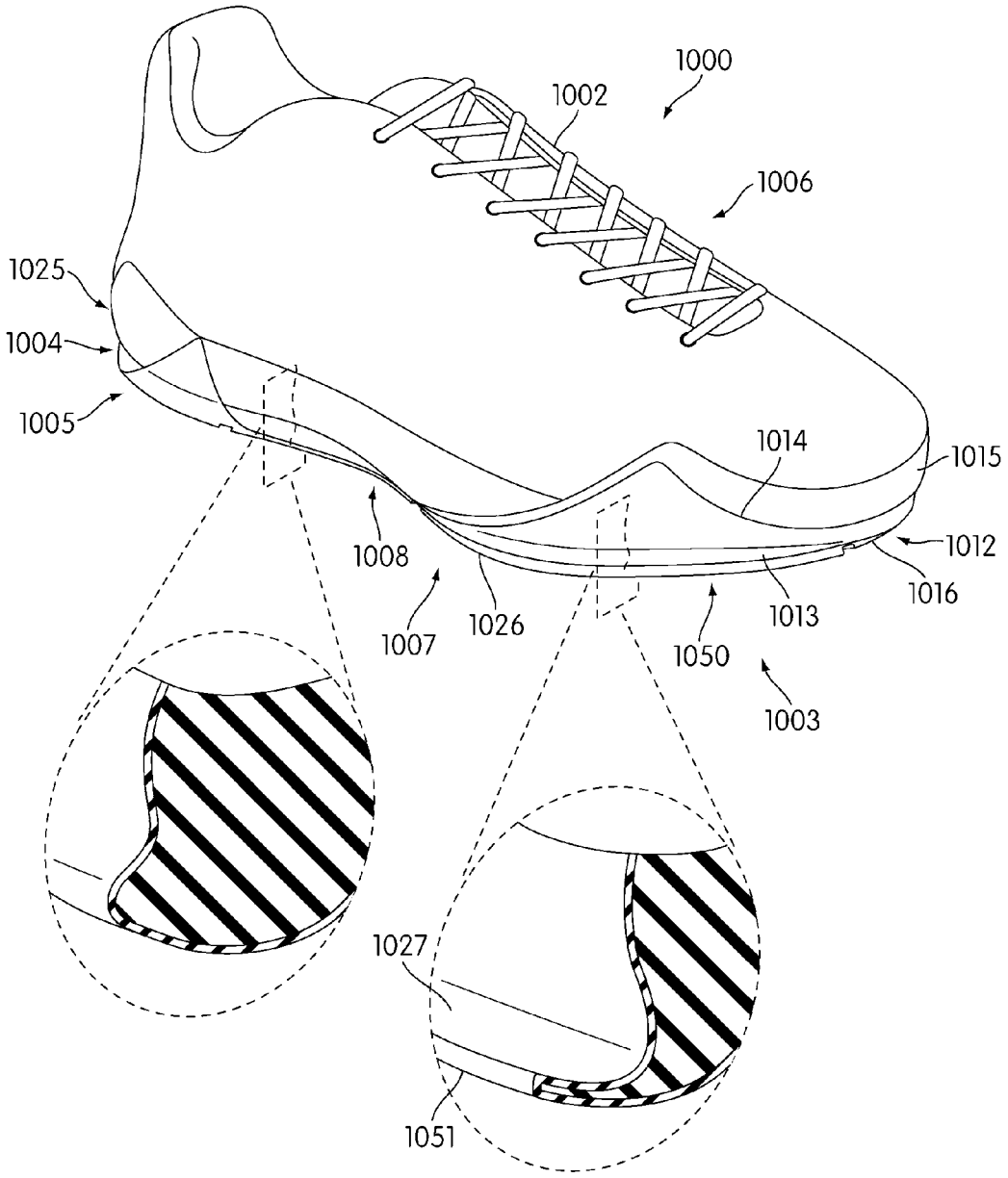
FIG. 10 is an isometric view of an exemplary embodiment of an article of footwear with enlarged cross sectional views of a sidewall portion of a sole.
Figure 11:
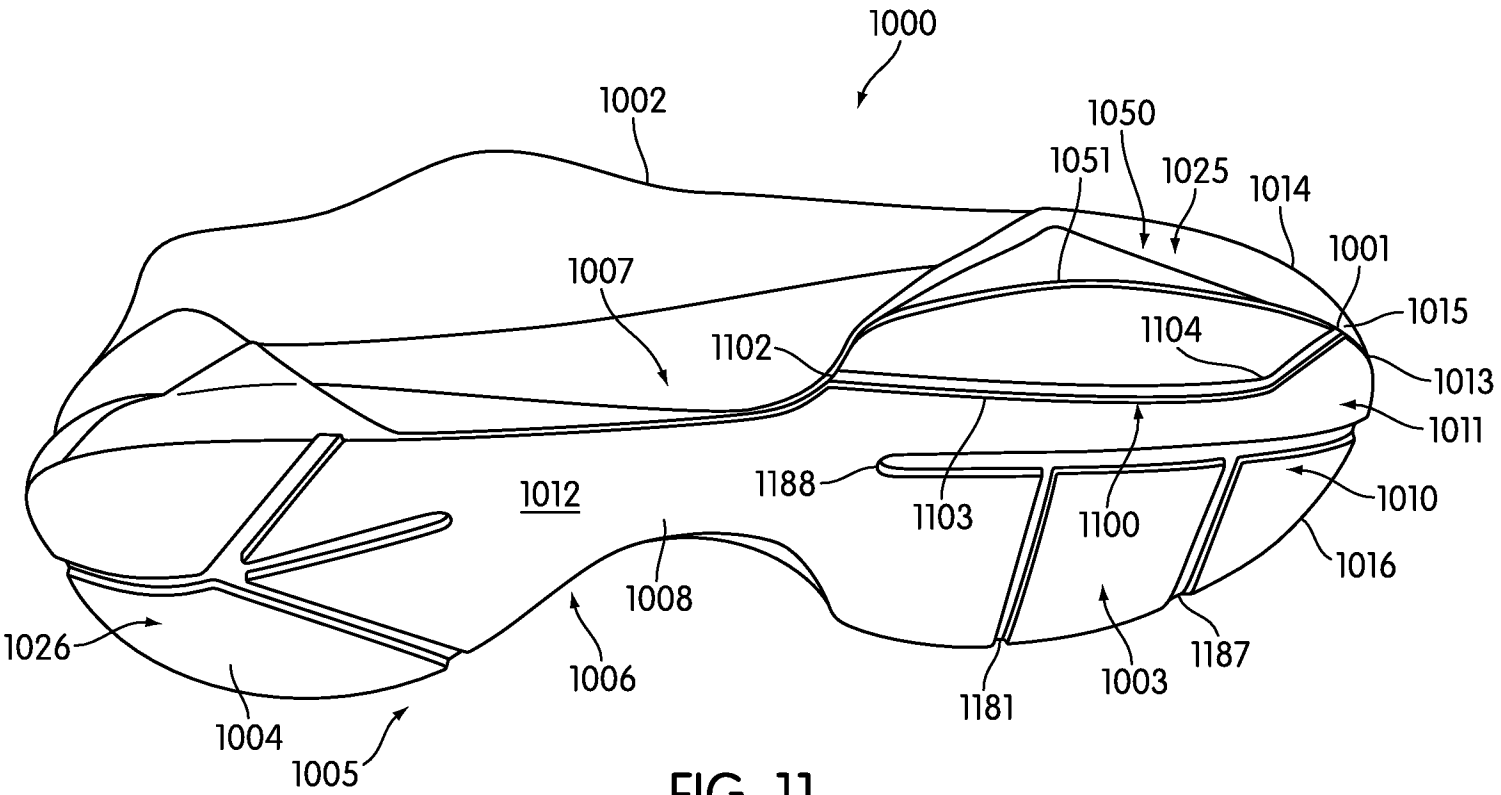
FIG. 11 is a bottom isometric view of an exemplary embodiment of an article of footwear with an outrigger portion and a flex groove.

FIGS. 10 and 11 illustrate an exemplary embodiment of article of footwear 1000. In particular, FIG. 10 is an isometric view of an exemplary embodiment of article of footwear 1000 and FIG. 11 is a bottom isometric view of an exemplary embodiment of article of footwear 1000. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 10 and 11, article of footwear 1000, also referred to simply as article 1000, is intended to be used with a right foot; however, it should be understood that the following discussion may equally apply to a mirror image of article of footwear 100 that is intended for use with a left foot.

Article of footwear 1000 includes upper 1002. Upper 1002 is configured to receive a foot of a wearer of article 1000. Generally, upper 1002 may be any type of upper. In particular, upper 1002 could have any design, shape, size and/or color. For example, in embodiments where article 1000 is a basketball shoe, upper 1002 could be a high top upper that is shaped to provide high support on an ankle. In embodiments where article 1000 is a running shoe, upper 1002 could be a low top upper.

Article 1000 also includes sole 1005. In different embodiments, sole 1005 may include different components. For example, sole 1005 may include an outsole, a midsole, and/or an insole. In one embodiment, sole 1005 includes midsole 1025 and outsole 1026.

In some embodiments, outsole 1026 includes lower surface 1012. Lower surface 1012 may be configured to contact a ground surface. Examples of ground surfaces include, but are not limited to: indoor ground surfaces such as wood and concrete floors, pavement, natural turf, synthetic turf, dirt, as well as other surfaces In some embodiments, midsole 1025 includes upper portion 1014. Upper portion 1014 may be associated with upper 1002. In a similar manner, midsole 1025 includes lower portion 1013. Lower portion 1013 may be disposed adjacent to outsole 1026. In some cases, lower portion 1013 may also include outer peripheral edge 1016. Outer peripheral edge 1016 may circumscribe lower portion 1013 of midsole 1025. In an exemplary embodiment, outer peripheral edge 1016 may also correspond to an outermost edge of outsole 1026.

Furthermore, midsole 1025 may be configured with sidewall portion 1015. The term "sidewall portion" as used throughout this detailed description and in the claims refers to an outer portion of midsole 1025 that extends from lower portion 1013 to upper portion 1014. In some cases, sidewall portion 1015 may extend from outer peripheral edge 1016 to upper 1002. This may allow sidewall portion 1015 to be visible on an exterior of article 1000. With this configuration, sidewall portion 1015 may circumscribe sole 1005.

Referring to FIG. 11, sole 1005 may comprise forefoot portion 1003. Forefoot portion 1003 may be associated with a forefoot of a foot inserted within article 1000. In some embodiments, forefoot portion 1003 may further include central portion 1010 and peripheral portion 1011 disposed outwards from central portion 1010. In some cases, peripheral portion 1011 may extend from central portion 1010 to outer peripheral edge 1016 of lower surface 1012.

In addition, sole 1005 includes heel portion 1004 that may be associated with a heel of a foot inserted within article 1000. Likewise, sole 1005 includes arch portion 1008. Arch portion 1008 may be disposed between forefoot portion 1003 and heel portion 1004.

Sole 1005 can also comprise medial portion 1006. Medial portion 1006 may be associated with an inside of a foot. Similarly, sole 1005 can comprise lateral portion 1007 disposed opposite of medial portion 1006. Lateral portion 1007 may be associated with an outside of a foot.

For consistency and convenience, directional adjectives are employed throughout this detailed description corresponding to the illustrated embodiments. The term "longitudinal" as used throughout this detailed description and in the claims refers to a direction extending a length of an article. Also, the term "lateral" as used throughout this detailed description and in the claims refers to a direction extending a width of an article. In other words, the lateral direction may extend between a medial and a lateral portion of a sole. Furthermore, the term "vertical" as used throughout this detailed description and in the claims refers to a direction generally perpendicular to a lateral and longitudinal direction. For example, in cases where a sole is planted flat on a ground surface, the vertical direction may extend from the ground surface upward.

A sole may include provisions to increase the lateral stability of an article. In some embodiments, a midsole may include an outrigger portion that extends outwards from a sole. By increasing the surface area of a sole, the outrigger portion can increase the lateral stability of the sole.

Referring to FIGS. 10 and 11, midsole 1025 includes outrigger portion 1050. Outrigger portion 1050 may be associated with different portions of sole 1005. In one embodiment, outrigger portion 1050 may extend outward from peripheral portion 1011 of lateral portion 1007. In some cases, outrigger portion 1050 may be disposed on forefoot portion 1003 and extend in a generally longitudinal direction to arch portion 1008. Although outrigger portion 1050 is disposed on a lateral side of forefoot portion 1003 in the current embodiment, it will be understood that in other embodiments outrigger portion 1050 may be disposed on a medial side of forefoot portion 1003.

Referring to FIG. 10, outrigger portion 1050 includes outrigger edge 1051. Outrigger edge 1051 may be associated with lower portion 1013 of midsole 1025. In some cases, outrigger edge 1051 may extend further outward in a substantially lateral direction than a portion of upper portion 1014 associated with outrigger portion 1050.

In some embodiments, outrigger portion 1050 may have a different cross sectional profile shape than other portions of midsole 1025. The term "cross sectional profile shape" as used throughout this detailed description and in the claims refers to a cross sectional shape of sidewall portion 1015 as sidewall portion 1015 extends between upper 1002 and lower surface 1012 of sole 1005. In some cases, sidewall portion 1015 may have a substantially flat shape in a generally perpendicular vertical direction. For example, as illustrated in a cross sectional view in FIG. 10, arch portion 1008 of sidewall portion 1015 may have a substantially flat shape in a generally vertical direction. In other cases, sidewall portion 1015 may have a curved shape. In an exemplary embodiment, outrigger portion 1050 of sidewall portion 1015 may have a concave cross sectional profile shape, as illustrated in a cross sectional view in FIG. 10.

In one embodiment, the concave cross sectional profile shape of outrigger portion 1050 may be configured so that lower portion 1013 of midsole 1025, associated with outrigger edge 1051, extends further outward than upper portion 1014 of midsole 1025. In some cases, this extension of outrigger edge 1051 can enhance the lateral agility of sole 1005 by providing some flexibility to outrigger portion 1050. With this arrangement, outrigger portion 1050 can provide lateral stability as well as lateral agility for sole 1005.

Generally, an outrigger portion can be associated with any portion of a sole. In some cases, an outrigger portion can be associated with a midsole. In other cases, an outrigger portion can be associated with an outsole. In an exemplary embodiment, an outrigger portion can be associated with both a midsole and an outsole.

In the exemplary embodiment, outsole 1026 may accommodate the shape of lower portion 1013 of outrigger portion 1050. In particular, outsole 1026 may include outrigger covering portion 1027 that is configured to wrap around midsole 1025 at outrigger portion 1050, including outrigger edge 1051. In some cases, covering portion 1027 may extend over some portions of sidewall portion 1015 of sole 1005. In one embodiment, covering portion 1027 may extend along sidewall portion 1015 towards upper 1002. With this arrangement, covering portion 1027 of outsole 1026 may help to protect sole 1005, especially at outrigger portion 1050. This arrangement can help prevent outrigger portion 1050 from being worn down with time and use.

It will be understood that in still other embodiments, outsole 1026 may only extend over a lower surface of sole 1005. In other words, in another embodiment, outsole 1026 may not be configured to cover outrigger portion 1050, including outrigger edge 1051.

A sole may include provisions to allow an outrigger portion to move substantially independently of a central portion of the sole. In some embodiments, a flexible material may be used in a portion of the sole to allow an outrigger portion to move substantially independently of the central portion of the sole. In other embodiments, a sole may include a flex groove that separates an outrigger portion from a central portion of a sole. In some cases, the flex groove may extend in a substantially longitudinal direction as the flex groove separates the outrigger portion from the central portion of the sole. Using this arrangement, the flex groove can allow the outrigger portion to move substantially independently of the central portion of the sole.

Referring to FIG. 11, sole 1005 includes flex groove 1100. Flex groove 1100 may be disposed on forefoot portion 1003 adjacent to outrigger portion 1050. In different embodiments, flex groove 1100 may be oriented in different directions on forefoot portion 1003, including, but not limited to: longitudinal, lateral and directions between a longitudinal and lateral direction. In one embodiment, flex groove 1100 may extend in a substantially longitudinal direction through forefoot portion 1003.

For purposes of clarity, sole 1005 is illustrated schematically in FIG. 11. In particular, sole 1005 is illustrated without tread elements. However, it should be understood that sole 1005 can be associated with various tread elements configured in different tread patterns.

In an exemplary embodiment, flex groove 1100 includes first end portion 1101 and second end portion 1102, disposed opposite of first end portion 1101. First end portion 1101 and second end portion 1102 may be disposed on outer peripheral edge 1016. In some cases, second end portion 1102 may be disposed adjacent to arch portion 1008. With this arrangement, flex groove 1100 may extend through forefoot portion 1003 toward arch portion 1008.

Flex groove 1100 may also include intermediate portion 1103 disposed between first end portion 1101 and second end portion 1102. In some embodiments, intermediate portion 1103 may be substantially straight as flex groove 1100 extends in a generally longitudinal direction. In other embodiments, intermediate portion 1103 may include one or more bends as flex groove 1100 extends in a generally longitudinal direction.

In one embodiment, intermediate portion 1003 includes angled portion 1104. Angled portion 1104 may bend slightly toward central portion 1010 of forefoot portion 1003 as flex groove 1100 extends from first end portion 1101. Following the slight bend toward central portion 1010, flex groove 1100 may extend in a generally longitudinal direction toward second end portion 1102.

As flex groove 1100 extends in a generally longitudinal direction, flex groove 1100 separates outrigger portion 1050 from central portion 1010. In some cases, outrigger edge 1051 may be disposed between first end portion 1101 and second end portion 1102 of flex groove 1100. In addition, intermediate portion 1103 may separate outrigger portion 1050 from central portion 1010.

Generally, flex groove 1100 can be formed in any manner known in the art. In some embodiments, flex groove 1100 may be formed by removing a portion of sole 1005. In some cases, a portion of outsole 1026 may be removed to form flex groove 1100. In other cases, a portion of outsole 1026 and midsole 1025 may be removed to form flex groove 1100. It is also possible that after removing a portion of sole 1005, flex groove 1100 may be filled with a more flexible material than materials comprising sole 1005. In an exemplary embodiment, flex groove 1100 may remain hollow. With this arrangement, flex groove 1100 may decrease the rigidity of sole 1005 and provide greater flexibility to sole 1005.

By separating outrigger portion 1050 from central portion 1010, flex groove 1100 can enable substantially independent movement of outrigger portion 1050 with respect to central portion 1010. In particular, the flexibility and substantially longitudinal orientation of flex groove 1100 may allow outrigger portion 1050 to move substantially independently of central portion 1010 in a generally lateral direction. For example, when a wearer of article 1000 moves in a lateral direction, sole 1005 may roll from side to side. As sole 1005 rolls toward later portion 1007, flex groove 1100 may allow outrigger portion 1050 to bend substantially independently of central portion 1010. This can increase the lateral agility of sole 1005. This will be discussed in more detail later in this detailed description.

In some embodiments, forefoot portion 1003 can be provided with additional flex grooves. For example, in one embodiment, forefoot portion 1003 may include central flex groove 1181, which may be disposed approximately midway between lateral and medial sides of sole 1005. In some cases, central flex groove 1181 may be approximately parallel with portions of flex groove 1100. This arrangement can help enhance lateral flexibility for sole 1005.

Furthermore, in some cases, forefoot portion 1003 can include first lateral flex groove 1187 and second lateral flex groove 1188. In an exemplary embodiment, first lateral flex groove 1187 and second lateral flex groove 1188 may be substantially perpendicular to central flex groove 1181. It will be understood that these additional flex grooves are intended to be optional and may not be present in some embodiments.

Generally, sole 1005 and upper 1002 may be made from materials known in the art for making articles of footwear. For example, sole 1005 may be made from any suitable material, including, but not limited to: elastomers, siloxanes, natural rubber, other synthetic rubbers, aluminum, steel, natural leather, synthetic leather, or plastics. Also, upper 1002 may be made from any suitable material, including, but not limited to: nylon, natural leather, synthetic leather, natural rubber or synthetic rubber. In some cases, upper 1002 can be made of any suitable knitted, woven or non-woven material.

Figure 12:
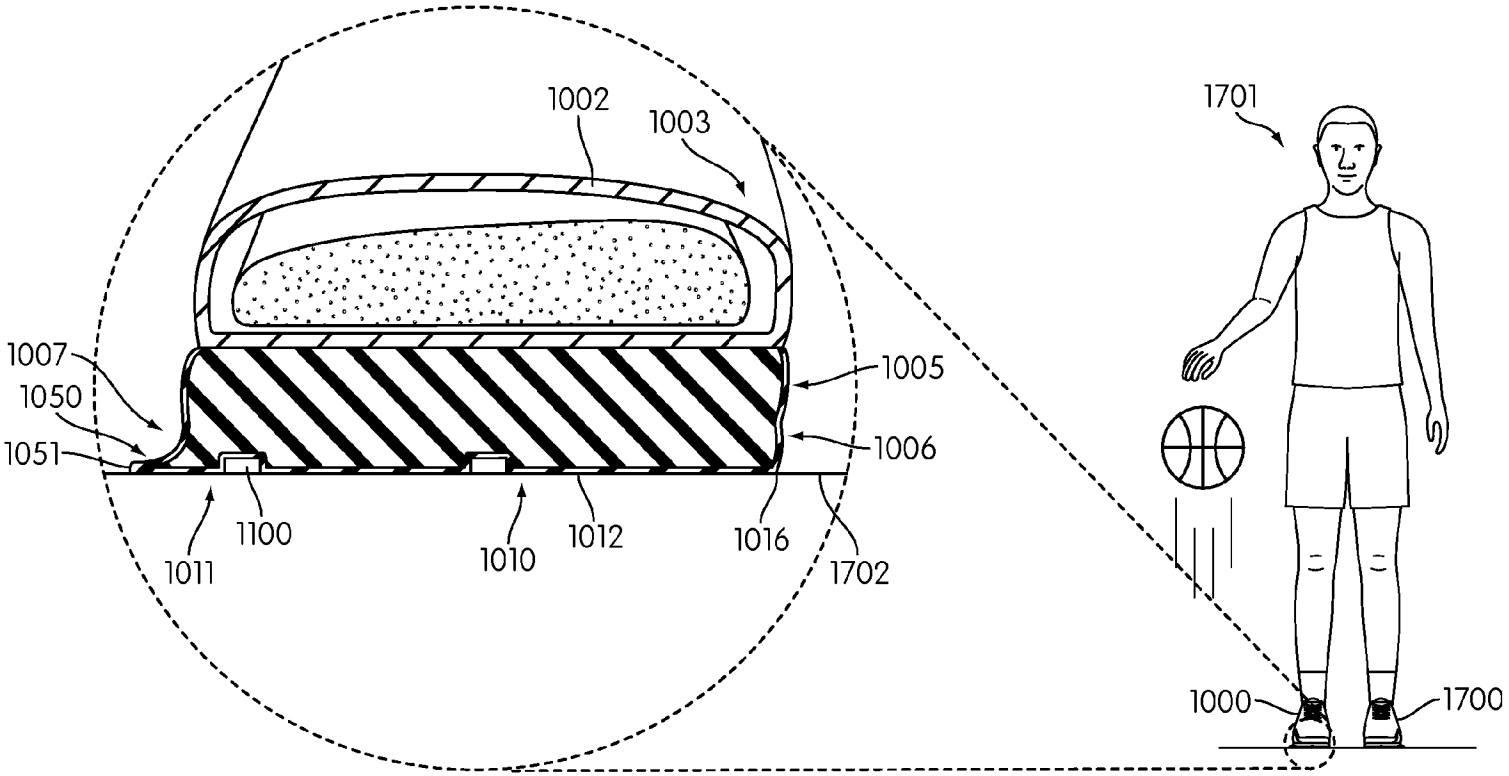
FIG. 12 is an exemplary embodiment of an athlete standing upright with an enlarged cross sectional view of a forefoot portion of an article.
Figure 13:
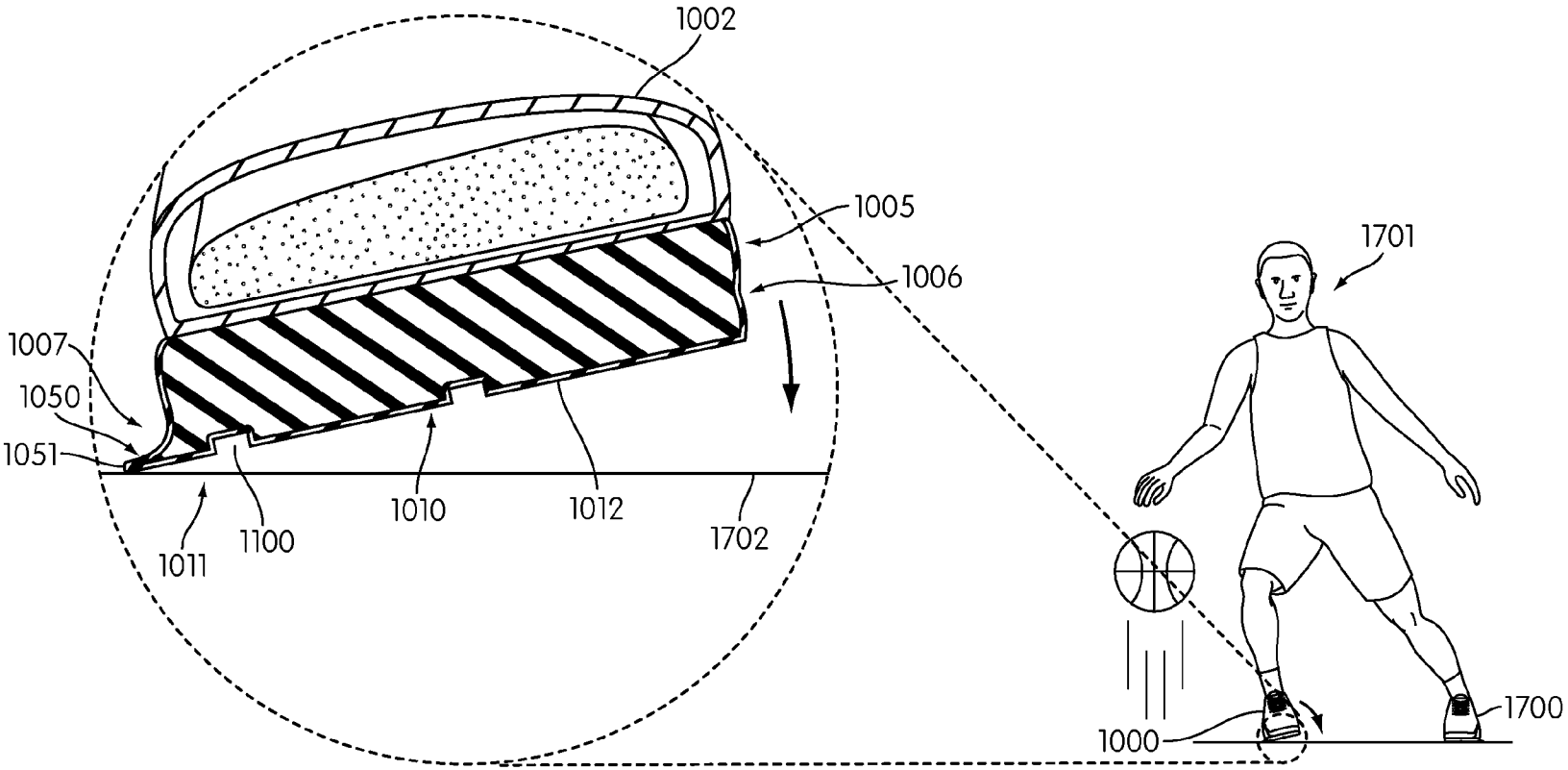
FIG. 13 is an exemplary embodiment of an athlete making a lateral maneuver with an enlarged cross sectional view of a forefoot portion of an article of footwear.
Figure 14:
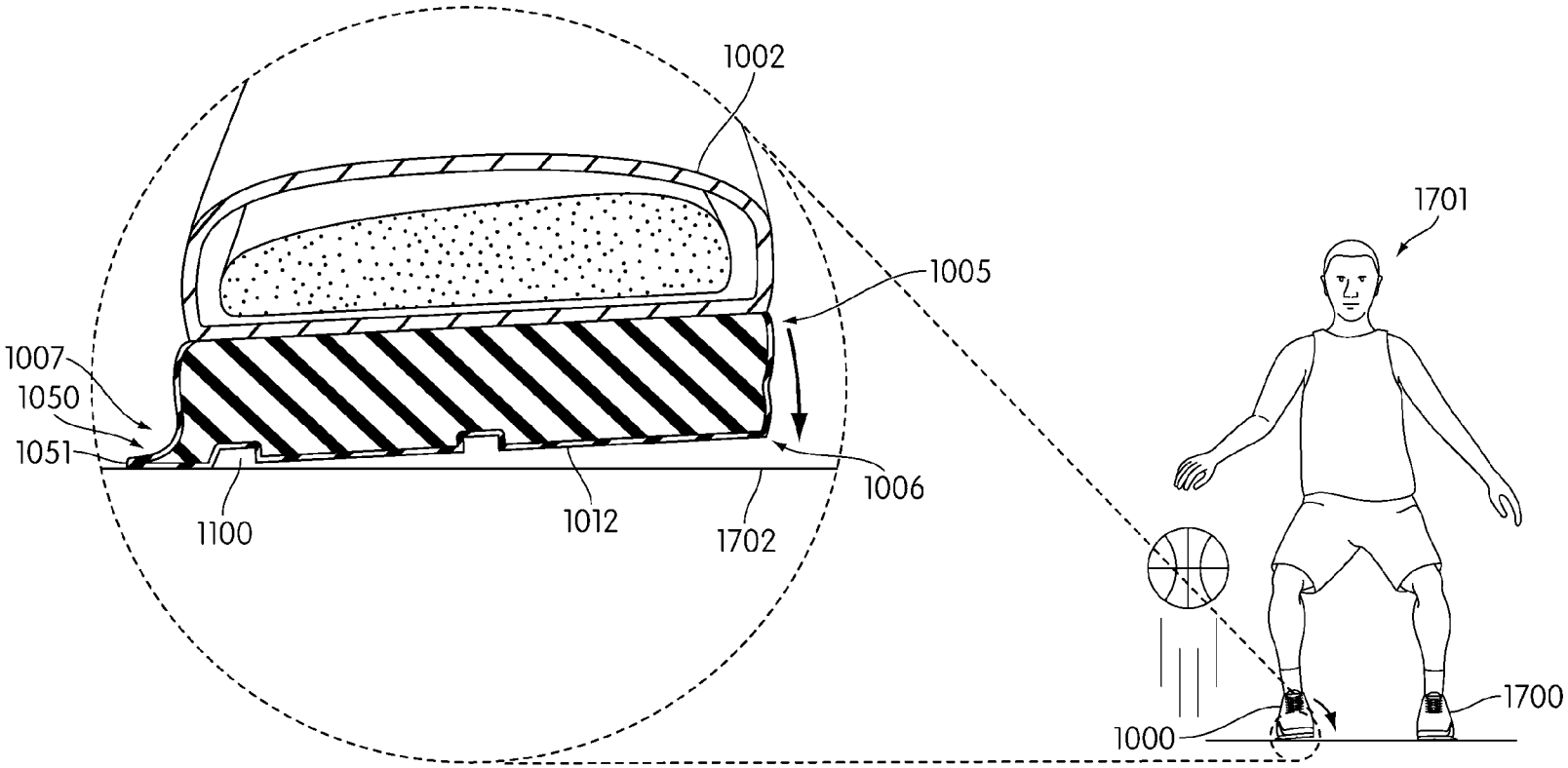
FIG. 14 is an exemplary embodiment of an athlete moving to place an article flat on a ground surface following a lateral maneuver with an enlarged cross sectional view of a forefoot portion of an article of footwear.

FIGS. 12-14 illustrate an exemplary embodiment of athlete 1701 standing upright as well as performing a lateral maneuver. In these embodiments, athlete 1701 wears article 1000 of the previous embodiment on a right foot. FIGS. 12-14 also include enlarged cross sectional views of an exemplary embodiment of forefoot portion 1003 of article 1000. These cross sectional views are intended to illustrate forefoot portion 1003 of sole 1005 as athlete 1701 stands upright and performs a lateral maneuver.

Although, these embodiments illustrate athlete 1701 as a basketball player, in other embodiments, athlete 1701 may play any sport and may play any position. Furthermore, athlete 1701 may wear article 1700 on a left foot. Article 1700 may be substantially similar to article 1000.

Referring to FIG. 12, athlete 1701 is standing upright. With athlete 1701 standing upright, an entirety of lower surface 1012 can contact a ground surface 1702. In particular, central portion 1010 and peripheral portion 1011 may lie substantially flat against ground surface 1702.

As peripheral portion 1011 lies substantially flat, outrigger portion 1050 may also be disposed in a substantially flat manner adjacent to ground surface 1702. By extending laterally outward from central portion 1010, outrigger portion 1050 increases the surface area of sole 1005 that contacts ground surface 1702. This arrangement allows outrigger portion 1050 to provide greater lateral stability for athlete 1701.

In some cases, during a lateral maneuver, an athlete may lean toward an edge of a sole. Referring to FIG. 13, athlete 1701 is making a lateral cut to a right side. During the lateral cut, article 1000 may roll toward lateral portion 1007 of sole 1005. This may cause medial portion 1006 and central portion 1010 to lose contact with ground surface 1702. In contrast, outrigger portion 1050 may move substantially independently of central portion 1010 and remain planted on ground surface 1702. For example, outrigger edge 1051, extended laterally outward from central portion 1010, may remain planted on ground surface 1702 as central portion 1010 is disposed above ground surface 1702.

In some cases, flex groove 1100 can facilitate the substantially independent movement of outrigger portion 1050 with respect to central portion 1010. In particular, flex groove 1100 may flex and extend in a generally lateral direction to allow outrigger portion 1050 to move substantially independently of central portion 1010. This can enhance the lateral stability and agility of athlete 1701 while making a lateral cut.

Following a lateral cut where an article leans toward one side of an article, an athlete may move back to a position where a substantial entirety of a lower surface of a sole may contact a ground surface. In some footwear systems, as the athlete moves to this position, the lower surface may move as a rigid body causing all portions of the lower surface to contact the ground at the same time. This can cause a jarring force to an athlete that may disturb the lateral stability and agility of the athlete. In embodiments with a flex groove and outrigger portion, the flex groove and outrigger portion may allow the sole to bend so a lower surface gradually contacts the ground surface until the entirety of the lower surface contacts a ground surface.

Referring to FIG. 14, athlete 1701 moves from a lateral cut to plant a substantial entirety of lower surface 1012 of sole 1005 on ground surface 1702 in a downward movement. By extending longitudinally through forefoot portion 1003, flex groove 1100 may allow sole 1005 to flex in a generally lateral direction. This configuration allows sole 1005 to roll toward ground surface 1702 in a gradual manner with portions of lower surface 1012 progressively contacting ground surface 1702 until an entirety of lower surface 1012 is planted on ground surface 1702. With this configuration, flex groove 1100, working in conjunction with outrigger portion 1050, can prevent the jarring force of an entirety of lower portion 1012 confronting ground surface 1702 in a downward movement at a substantially same time. This arrangement can enhance the lateral stability and agility of athlete 1701.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a sock liner including a heel counter portion, the sock liner being removably disposed within an interior of the article of footwear such that an exterior portion of the sock liner is disposed along an inner surface of an upper within the interior of the article of footwear and an interior portion of the sock liner including the heel counter portion is exposed to the interior of the article of footwear;

the sock liner including a longitudinal direction associated with a length of a sole;

the sock liner including a lateral direction associated with a width of the sole, the lateral direction being generally perpendicular to the longitudinal direction;

the sock liner including a vertical direction that is generally perpendicular to the longitudinal direction and the lateral direction;

the heel counter portion including a first heel counter section and a second heel counter section wherein the first heel counter section is disposed below the second heel counter section in a generally vertical direction;

the first heel counter section including a first end portion and a second end portion that are oriented substantially in the longitudinal direction;

the first end portion and the second end portion being separated by a first distance substantially oriented in the lateral direction;

the second heel counter section including a third end portion and a fourth end portion that are oriented substantially in the longitudinal direction;

the third end portion and the fourth end portion being separated by a second distance substantially oriented in the lateral direction; and wherein the first distance is greater than the second distance;

wherein the first heel counter section and the second heel counter section have similar cross-sectional shapes;

wherein the first heel counter section and the second heel counter section comprise a single monolithic heel counter portion that is integrally formed with the sock liner as a single piece;

wherein the sock liner defines a bottom of the first heel counter section and wherein the second heel counter section is open along the vertical direction to extend around a portion of a heel;

wherein the sock liner extends over a substantial entirety of a foot bed of the article of footwear from a heel portion to a forefoot portion;

wherein the sock liner is substantially flat at the forefoot portion; and wherein the heel counter portion is configured so as to terminate within the heel region of the sock liner in the longitudinal direction and is further configured so as to not extend above an ankle of a wearer of the article of footwear in the vertical direction.

2. The article of footwear according to claim 1, wherein the first heel counter section is configured to receive a bottom portion of the heel.

3. The article of footwear according to claim 1, wherein the second heel counter portion is configured to receive a top portion of the heel.

4. The article of footwear according to claim 1, wherein a first intermediate portion is disposed between the first end portion and the second end portion and wherein the first intermediate portion has an interior portion associated with a first curvature.

5. The article of footwear according to claim 4, wherein a second intermediate portion is disposed between the third end portion and the fourth end portion and wherein the second intermediate portion has an interior portion associated with a second curvature that is greater than the first curvature.

6. The article of footwear according to claim 4, wherein the second intermediate portion is disposed closer to a forefoot portion of the sock liner than the first intermediate portion in the longitudinal direction.

7. The article of footwear according to claim 4, wherein the heel counter portion includes a third heel counter section disposed between the first heel counter section and the second heel counter section and wherein the third heel counter section includes a fifth end portion and a sixth end portion that are separated by a third distance in the lateral direction and wherein the third distance is greater than the first distance.

8. An article of footwear, comprising:

a sock liner including a heel counter portion integrally formed with the sock liner so as to be a single piece, the sock liner being removably disposed within an interior of the article of footwear such that an exterior portion of the sock liner is disposed along an inner surface of an upper within the interior of the article of footwear and an interior portion of the sock liner including the heel counter portion is exposed to the interior of the article of footwear;

the sock liner including a longitudinal direction associated with a length of a sole;

the sock liner including a lateral direction associated with a width of the sole, the lateral direction being generally perpendicular to the longitudinal direction;

the sock liner including a vertical direction that is generally perpendicular to the longitudinal direction and the lateral direction;

the heel counter portion including a first heel counter section and a second heel counter section wherein the first heel counter section is disposed below the second heel counter section in a generally vertical direction;

the first heel counter section including a first end portion, a second end portion and a first intermediate portion disposed between the first end portion and the second end portion;

the second heel counter section including a third end portion, a fourth end portion and a second intermediate portion disposed between the third end portion and the fourth end portion;

wherein the first intermediate portion has a first curvature that is greater than a second curvature associated with the second intermediate portion;

wherein the first heel counter section includes a bottom formed by the sock liner and wherein the second heel counter section is open along the vertical direction above the bottom of the first heel counter section;

wherein the sock liner extends over a substantial entirety of a foot bed of the article of footwear from a heel portion to a forefoot portion;

wherein the sock liner is substantially flat at the forefoot portion; and wherein the heel counter portion is configured so as to terminate within the heel region of the sock liner in the longitudinal direction and is further configured so as to not extend above an ankle of a wearer of the article of footwear in the vertical direction.

9. The article of footwear according to claim 8, wherein the first curvature is associated with a first interior portion of the first heel counter section and wherein the second curvature is associated with a second interior portion of the second heel counter section.

10. The article of footwear according to claim 8, wherein the first end portion and the second end portion are separated by a first distance substantially oriented in the lateral direction and wherein the third end portion and the fourth end portion that are separated by a second distance substantially oriented in the lateral direction and wherein the first distance is different than the second distance.

11. The article of footwear according to claim 10, wherein the first distance is greater than the second distance.

12. The article of footwear according to claim 8, wherein the first heel counter section is disposed adjacent to a base portion of a heel.

13. The article of footwear according to claim 12, wherein the second heel counter section is disposed adjacent to an ankle portion of a heel.

14. The article of footwear according to claim 8, wherein the heel counter portion includes a third heel counter section disposed between the first heel counter section and the second heel counter section in the vertical direction and wherein the third heel counter section includes a fifth end portion, a sixth end portion and a third intermediate portion disposed between the fifth end portion and the sixth end portion and wherein the third intermediate portion has a third curvature that is less than the first curvature; and wherein the third heel counter section is open along the vertical direction above the bottom of the first heel counter section.

15. An article of footwear, comprising:

an upper;

a sock liner including a heel counter portion integrally formed with the sock liner, the sock liner removably disposed inside of the upper such that an exterior portion of the sock liner is disposed along an inner surface of the upper and an interior portion of the sock liner including the heel counter portion is exposed to an interior of the article of footwear;

the sock liner including a longitudinal direction associated with a length of a sole;

the sock liner including a lateral direction associated with a width of the sole, the lateral direction being generally perpendicular to the longitudinal direction;

the sock liner including a vertical direction that is generally perpendicular to the longitudinal direction and the lateral direction;

the heel counter portion including a first heel counter section and a second heel counter section wherein the first heel counter section is disposed below the second heel counter section in a generally vertical direction;

wherein a portion of the first heel counter section extends rearwards of the second heel counter section in the longitudinal direction;

wherein the first heel counter section and the second heel counter section form a single monolithic heel counter portion that is integrally formed with the sock liner as a single piece, the monolithic heel counter portion having a bottom along the first heel counter section defined by the sock liner to receive a bottom portion of a heel and a flat top edge along the second heel counter section that is open through the vertical direction to receive an upper portion of the heel;

wherein the sock liner extends over a substantial entirety of a foot bed of the article of footwear from a heel portion to a forefoot portion;

wherein the sock liner is substantially flat at the forefoot portion; and wherein the monolithic heel counter portion is configured so as to terminate within the heel region of the sock liner in the longitudinal direction and is further configured so as to not extend above an ankle of a wearer of the article of footwear in the vertical direction.

16. The article of footwear according to claim 15, wherein the first heel counter section includes a first end portion, a second end portion and a first intermediate portion disposed between the first end portion and the second end portion and wherein the second heel counter section includes a third end portion, a fourth end portion and a second intermediate portion disposed between the third end portion and the fourth end portion and wherein the first intermediate portion has a first curvature than is greater than a second curvature associated with the second intermediate portion.

17. The article of footwear according to claim 15, wherein the first heel counter section is wider than the second heel counter section in a substantially lateral direction.

18. The article of footwear according to claim 16, wherein the first intermediate portion is disposed closer to a heel portion of the sock liner than the second intermediate portion in a substantially longitudinal direction.

19. The article of footwear according to claim 15, wherein the heel counter portion includes a third heel counter section disposed between the first heel counter section and the second heel counter section in the vertical direction and wherein the third heel counter section extends further rearwards of the first heel counter section and the second heel counter section in the longitudinal direction.

20. An article of footwear, comprising:

an upper;

a sock liner removably disposed within an interior of the article of footwear formed by the upper, the sock liner including a heel counter portion, the heel counter portion integrally formed with the sock liner, the sock liner arranged within the interior of the article of footwear such that an exterior portion of the sock liner is disposed along an inner surface of the upper and an interior portion of the sock liner including the heel counter portion is exposed to the interior of the article of footwear;

the sock liner including a longitudinal direction associated with a length of the sole; the sock liner including a lateral direction associated with a width of a sole, the lateral direction being generally perpendicular to the longitudinal direction;

the sock liner including a vertical direction that is generally perpendicular to the longitudinal direction and the lateral direction;

the heel counter portion comprising a single monolithic heel counter portion including a first heel counter section and a second heel counter section wherein the first heel counter section is disposed below the second heel counter section in a generally vertical direction;

the first heel counter section including a first end portion and a second end portion that are oriented substantially in the longitudinal direction;

the first end portion and the second end portion being separated by a first distance substantially oriented in the lateral direction;

the second heel counter section including a third end portion and a fourth end portion that are oriented substantially in the longitudinal direction;

the third end portion and the fourth end portion being separated by a second distance substantially oriented in the lateral direction;

the first heel counter section including a first intermediate portion disposed between the first end portion and the second end portion, the first intermediate portion being associated with a first curvature;

the second heel counter section including a second intermediate portion disposed between the third end portion and the fourth end portion, the second intermediate portion being associated with a second curvature;

wherein the first distance is greater than the second distance and wherein the first curvature is greater than the second curvature and wherein the first heel counter section is disposed further rearward of the second heel counter section in the longitudinal direction;

wherein the article of footwear further includes a bootie that fits inside the upper;

wherein a bottom of the bootie is disposed above the sock liner and the heel counter portion of the sock liner receives a heel portion of the bootie;

wherein the heel portion of the bootie has a contoured shape that corresponds with a contoured shape of the heel counter portion;

wherein the sock liner extends over a substantial entirety of a foot bed of the article of footwear from a heel portion to a forefoot portion; and wherein the sock liner is substantially flat at the forefoot portion.

21. The article of footwear according to claim 20, wherein the first heel counter section includes a bottom formed by the sock liner and wherein the second heel counter section is open along the vertical direction above the bottom of the first heel counter section.

22. The article of footwear according to claim 20, wherein geometry of the heel counter portion is configured to conform to the shape of a heel.

23. The article of footwear according to claim 21, wherein the heel portion of the bootie has a geometry that conforms to the shape of a heel.

* * * * *